US008955591B1

(12) United States Patent
Hytken

(10) Patent No.: US 8,955,591 B1
(45) Date of Patent: Feb. 17, 2015

(54) METHODS AND SYSTEMS FOR DELIVERY OF THERMAL ENERGY

(75) Inventor: Kent B. Hytken, San Diego, CA (US)

(73) Assignee: Future Energy, LLC, Dayton, OH (US)

( * ) Notice: Subject to any disclaimer, the term of this patent is extended or adjusted under 35 U.S.C. 154(b) by 795 days.

(21) Appl. No.: 13/107,711

(22) Filed: May 13, 2011

Related U.S. Application Data

(60) Provisional application No. 61/334,552, filed on May 13, 2010.

(51) Int. Cl.
*E21B 36/00* (2006.01)
*E21B 43/24* (2006.01)

(52) U.S. Cl.
USPC ..... 166/302; 166/57; 166/367

(58) Field of Classification Search
USPC ..... 166/302, 303, 57, 257, 366, 367; 422/198
See application file for complete search history.

(56) References Cited

U.S. PATENT DOCUMENTS

| | | | | |
|---|---|---|---|---|
| 2,634,961 | A | 4/1953 | Ljungstrom | |
| 2,732,195 | A | 1/1956 | Ljungstrom | |
| 2,780,450 | A | 2/1957 | Ljungstrom | |
| 2,789,805 | A | 4/1957 | Ljungstrom | |
| 2,923,535 | A | 2/1960 | Ljungstrom | |
| 3,205,012 | A | 9/1965 | Dancy | |
| 3,237,689 | A | 3/1966 | Justheim | |
| 3,438,442 | A | 7/1966 | Pryor et al. | |
| 3,493,050 | A | 2/1970 | Kelley et al. | |
| 3,498,381 | A | 3/1970 | Earlougher | |
| 4,085,803 | A | 4/1978 | Butler | |
| 4,641,710 | A | 2/1987 | Klinger | |
| 4,671,351 | A | 6/1987 | Rappe | |
| 4,803,054 | A | 2/1989 | Sillerud et al. | |
| 4,886,118 | A | 12/1989 | Van Meurs et al. | |
| 5,040,605 | A | 8/1991 | Showalter | |
| 5,052,482 | A | 10/1991 | Gondouin | |
| 5,366,012 | A | 11/1994 | Lohbeck | |
| 5,816,325 | A | 10/1998 | Hytken | |
| 6,354,373 | B1 | 3/2002 | Vercaemer et al. | |
| 7,147,057 | B2 | 12/2006 | Steele et al. | |
| 7,367,399 | B2 * | 5/2008 | Steele et al. | 166/303 |
| 7,743,826 | B2 | 6/2010 | Harris et al. | |
| 7,798,221 | B2 | 9/2010 | Vinegar et al. | |
| 7,832,482 | B2 | 11/2010 | Cavender et al. | |

(Continued)

FOREIGN PATENT DOCUMENTS

| | | |
|---|---|---|
| GB | 1 228 437 | 4/1971 |

OTHER PUBLICATIONS

International Search Report and Written Opinion dated Jan. 27, 2012, relating to International Patent Application No. PCT/US2011/048325.

(Continued)

*Primary Examiner* — Catherine Loikith
(74) *Attorney, Agent, or Firm* — Dinsmore & Shohl LLP

(57) ABSTRACT

A system and method of recovering hydrocarbons located at or above a sea floor of a sea are disclosed. The method includes heating a working fluid at a heater and delivering the working fluid downward into the sea through a first string of a riser to a heat exchanger. The riser has a plurality of strings in a concentric arrangement. The heat exchanger transfers thermal energy from the working fluid to at least hydrocarbons to enable recovery of the hydrocarbons through a second string of the riser. The working fluid returns from the heat exchanger to the heater through a third string of the riser.

20 Claims, 3 Drawing Sheets

(56) References Cited

U.S. PATENT DOCUMENTS

| | | | |
|---|---|---|---|
| 7,832,484 | B2 | 11/2010 | Nguyen et al. |
| 7,841,408 | B2 | 11/2010 | Vinegar |
| 7,845,411 | B2 | 12/2010 | Vinegar et al. |
| 7,921,907 | B2 | 4/2011 | Burnham et al. |
| 8,225,866 | B2 | 7/2012 | De Rouffignac et al. |
| 2005/0072567 | A1 | 4/2005 | Steele et al. |

OTHER PUBLICATIONS

Colombian first Office Action dated Dec. 7, 2013, relating to Columbian Patent Application No. 1352526.

* cited by examiner

METHODS AND SYSTEMS FOR DELIVERY OF THERMAL ENERGY

RELATED APPLICATIONS

This application claims priority to U.S. Provisional Application No. 61/334,552, titled METHODS AND SYSTEMS FOR DELIVERY OF THERMAL ENERGY, filed May 13, 2010, incorporated herein by reference in its entirety for all purposes.

BACKGROUND OF THE INVENTION

Oil and gas exploration and extraction often encounter extreme conditions. For example, off-shore oil drilling and production operations encounter extreme cold temperatures at the sea floor, resulting in a variety of problems, such as the formation of hydrates or profound increase of viscosity of some crude oils which can clog subsurface, seafloor, and riser production facilities.

SUMMARY OF THE INVENTION

Various embodiments of the present invention provide for the delivery of thermal energy, or heat, thereby preventing the formation of hydrates or the increase in viscosity of crude oil, for example.

DETAILED DESCRIPTION OF THE PREFERRED EMBODIMENTS

Extraction of oil from the sea floor (e.g., via offshore drilling) presents many challenges. One of these challenges relate to the harsh environment which may exist at the sea floor. For example, as encountered by the effort to stop the oil leak in the Gulf of Mexico in May 2010, cold temperatures at the sea floor can result in the formation of hydrates which can clog a line.

Embodiments of the present invention can:

1. deliver heat to sea-floor oil and gas drilling and production facilities;
2. deliver and distribute heat to risers, flow lines, tool strings and other devices between the surface facilities and the sea floor facilities;
3. deliver and distribute heat to sub-sea floor and downhole tubular systems and drilling and production facilities and devices; and 4. deliver and distribute heat to sea floor and sub-sea floor mining facilities and processes.

Figure 1:
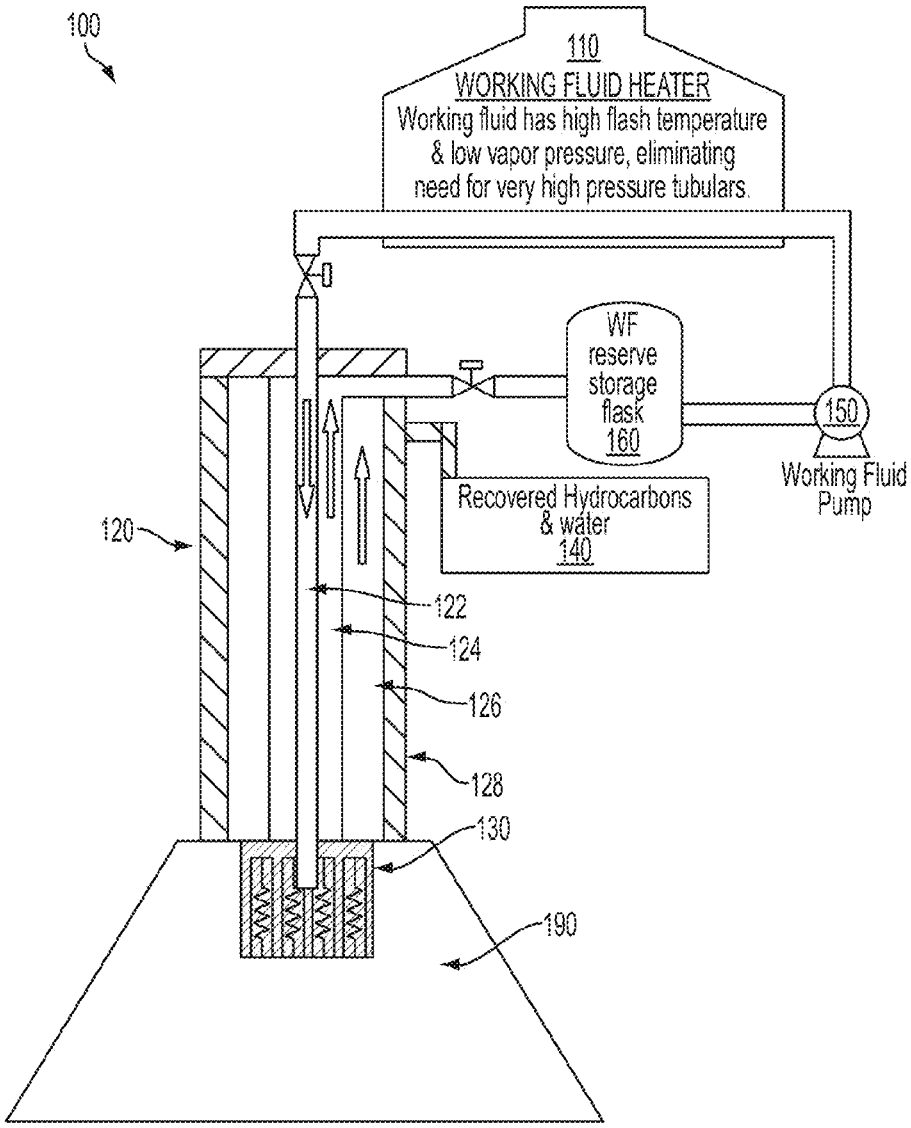
FIG. 1 is a schematic illustration of a heat delivery and distribution system in accordance with one embodiment.

Referring first to FIG. 1, a schematic illustration of a heat delivery and distribution system 100 in accordance with one embodiment is provided. The system 100 provides a closed-loop system for heating a working fluid and delivering the hot working fluid to the sea floor, for example, to provide thermal energy to the oil extraction system (e.g., well head, recovery bell, etc.). The system comprises a heater 110 configured to heat a working fluid to a high temperature. The heater 110 is positioned on the surface (e.g., on a vessel or a rig) and is configured to operate on any of a variety of energy sources. For example, in one embodiment, the heater 110 operates using combustion of a fuel.

The working fluid is heated by the heater 110 to a very high temperature. In this regard, the working fluid should have a very high boiling point. In one embodiment, the working fluid is molten salt with a boiling temperature of approximately 1150° F. Thus, the heater 110 heats the working fluid to a temperature as high as 1150° F. In other embodiments, the working fluid is heated to a temperature of 900° F. or another temperature. Preferably, the working fluid is heated to a temperature that is greater than 700° F.

Figure 1A:
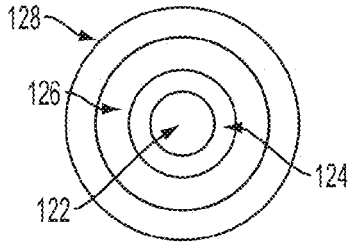
FIG. 1A depicts a riser system of the heat delivery and distribution system of FIG. 1 configured in a set of concentric tubes.

Referring again to FIG. 1, the heated working fluid is delivered to the sea floor through a riser system 120. The length of the riser system 120 corresponds to the depth of the well head, for example, which may be located at an underwater depth of 5000 feet or more. In accordance with the embodiment of FIG. 1, the riser system 120 is configured in the form of a set of concentric tubes (as depicted by FIG. 1A). The concentric tubes provide a string or annulus for each of a plurality of distinct purposes.

In the embodiment of FIG. 1, the center string 122 of the riser system 120 is used to transport the heated working fluid to a recovery bell 190. The heated working fluid is pumped through the center string 122 at a very high flow rate to minimize loss of heat to the sea water. In one embodiment, the center string 122 is a tube having a diameter of approximately 0.75 inches or more. In other embodiments, the center string 122 may be sized according to factors such as pump capability, distance between surface and the well head or recovery bell, and the type of working fluid, for example.

The heated working fluid is delivered to a heat exchanger 130 positioned within the recovery bell 190. The recovery bell 190 is configured to trap hydrocarbons venting at or above the sea floor (e.g., mud line). The hydrocarbons experience a rapid heat loss due to decrease in pressure and expansion of gas, as well as contact with the sea water at a great depth, such as 5000 feet. This heat loss results in formation of hydrates which can clog the pathway from the recovery bell 190 to the riser system 120.

The heat exchanger 130 is configured to transfer heat from the working fluid to the recovery bell 190. Rapid delivery of heat prevents hydrate formation or causes the hydrates to flash back to vapor phase, thereby preventing clogging of the recovery bell 190 and riser system 120.

The cooled working fluid is returned to the surface through a first annulus 124 of the riser system 120. In one embodiment, the first annulus 124 has an outer diameter of between 2.5 and 3 inches, and in a particular embodiment has an outer diameter of 2.875 inches. Insulation may be provided between the outer wall of the center string 122 and the inner wall of the first annulus 124 to minimize loss of heat from the hot working fluid in the center string 122. However, a certain amount of heat transfer between the hot working fluid in the center string 122 and the returning working fluid in the first annulus 124 may occur.

A second annulus 126 is used to transfer recovered hydrocarbon from the recovery bell 190 to the surface. The recovered hydrocarbons may pick up some heat from the adjacent first annulus 124 having the returning working fluid. Additionally, the recovered hydrocarbons may lose some heat through the outer wall of the second annulus 126. In one embodiment, the second annulus 126 has an outer wall formed of a 5.5-inch casing.

An outer riser annulus 128 forms the outer wall of the riser system 120. The outer annulus 128 is an insulated riser configured to minimize heat loss to sea water. In one embodiment, the outer annulus 128 has a diameter of between 12 and 16 inches.

The recovered hydrocarbons are transported from the recovery bell 190 to the surface through the second annulus 126 and may be stored in a storage unit 140. The storage unit 140 may be an oil tanker or other unit capable of storing the hydrocarbons, at least on a temporary basis. It should be noted that the hydrocarbons transported from the recovery bell 190 and stored in the storage unit 140 may be a mixture of hydrocarbons and water, for example.

As noted above, the working fluid is heated and pumped to the recovery bell 190 in a closed-loop system. In this regard, the system 100 includes a working fluid pump 150 that is preferably positioned on the cold side of the heater 110. The pump 150 is sized according to the particular needs of the system as implemented. Additionally, a reserve storage flask 160 containing additional working fluid is included in the closed loop to ensure sufficient working fluid in the system.

Thus, working fluid is pumped by the working fluid pump 150 into the heater 110. The heated working fluid is then transported to the recovery bell 190 via the center string 122 of the riser system 120. At the recovery bell 190, the heat exchanger 130 transfers heat from the working fluid to the hydrocarbons in the recovery bell 190, and the working fluid is returned to the surface via the first outer annulus 124. Additionally, various valves may be provided to control operation of the system 100.

Figure 2:
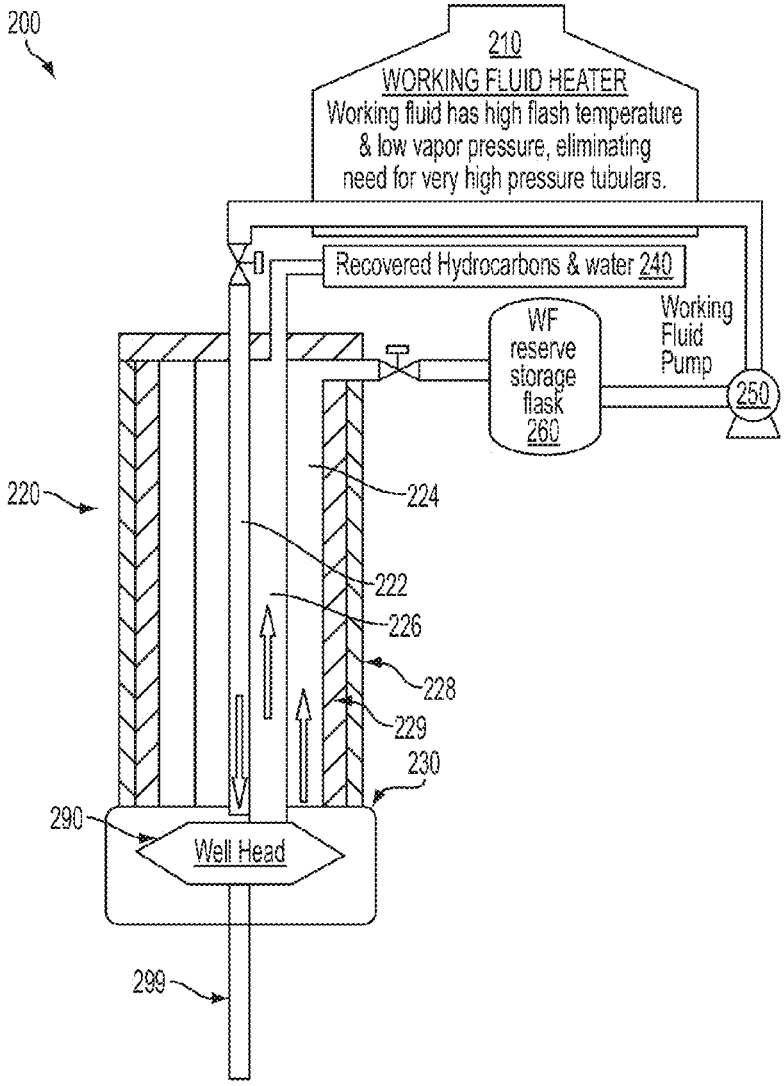
FIG. 2 is a schematic illustration of a heat delivery and distribution system in accordance with another embodiment.

Referring now to FIG. 2, a schematic illustration of a heat delivery and distribution system in accordance with another embodiment is illustrated. The system 200 of FIG. 2 is similar to that illustrated in FIG. 1 and provides a closed-loop system for heating a working fluid and delivering the hot working fluid to a well head, for example. The system 200 comprises a heater 210 configured to heat a working fluid to a high temperature. The heater 210 is positioned on the surface (e.g., on a vessel or a rig) and is configured to operate on any of a variety of energy sources.

Figure 2A:
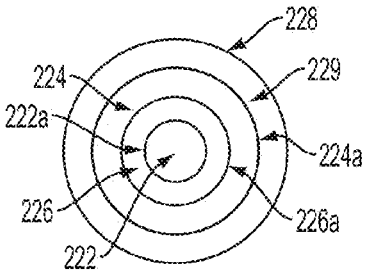
FIG. 2A depicts a riser system of the heat delivery and distribution system of FIG. 2 configured in a set of concentric tubes.

The heated working fluid is delivered to the sea floor through a riser system 220, the length of the riser system 220 corresponding to the depth of the well head, for example. In accordance with the embodiment of FIG. 2, the riser system 220 is configured in the form of a set of concentric tubes 222*a*, 226*a* and 224*a* (as depicted by FIG. 2A).

In the embodiment of FIG. 2, the center string 222 of the riser system 220 has an outer wall and is used to transport the heated working fluid to a well head 290. The heated working fluid is pumped through the center string 222 at a very high flow rate to minimize loss of heat to the sea water.

The heated working fluid is delivered to a heat exchanger 230 positioned around the well head 290. In the embodiment of FIG. 2, the heat exchanger is in a jacket surrounding the well head components. The heat exchanger serves to melt hydrates and to lower viscosity of heavy or waxy crude, allowing the produced hydrocarbons to rise up through the riser system 220.

The well head 290 sits at or above the mud line (e.g., sea floor) and is connected to a production tubing string 299 extending to the hydrocarbon deposit, for example.

The recovered hydrocarbons are transported from the well head 290 to the surface through a first annulus 226. The recovered hydrocarbons gain heat from the hot working fluid in the center string 222. The cooled working fluid is returned to the surface through a second annulus 224 of the riser system 220.

An outer riser wall 228 forms the outer wall of the riser system 220. The outer riser wall 228 is an insulated riser configured to minimize heat loss to sea water. The outer rise wall 228 forms an outer riser annulus 229. The outer rise annulus 229 and the outer riser wall 228 provide insulation to prevent heat loss to the sea water.

The recovered hydrocarbons are transported from the well head 290 to the surface through the first annulus 226 and may be stored in a storage unit 240. As noted above, the storage unit 240 may be an oil tanker or other unit capable of storing the hydrocarbons, at least on a temporary basis.

The closed-loop system for the working fluid includes a working fluid pump 250 that is preferably positioned on the cold side of the heater 210. Additionally, a reserve storage flask 260 containing additional working fluid is included in the closed loop to ensure sufficient working fluid in the system.

Figure 3:
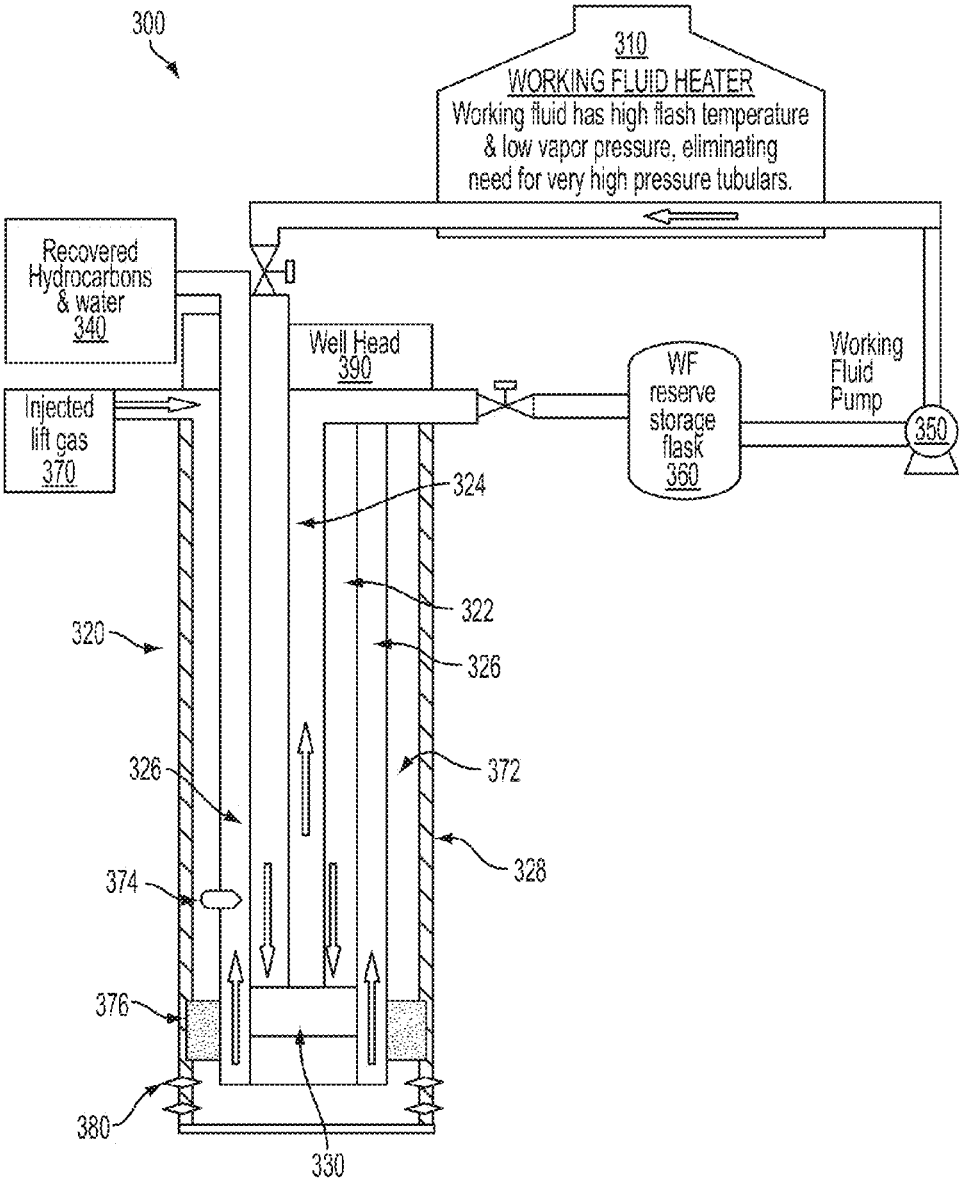
FIG. 3 is a schematic illustration of a heat delivery and distribution system in accordance with another embodiment.

Referring now to FIG. 3, a schematic illustration of a heat delivery and distribution system in accordance with another embodiment is provided. The system 300 of FIG. 3 is configured to inject a lift gas (e.g., methane) into the recovered hydrocarbon to enhance recovery. Further, in the embodiment illustrated in FIG. 3, the well head 390 is shown at the top of the figure, as may be the case for an oil well on land. However, those skilled in the art will understand that the concepts described herein may be applicable to off-shore wells also.

The system 300 of FIG. 3 is similar to that illustrated in FIGS. 1 and 2 and provides a closed-loop system for heating a working fluid and delivering the hot working fluid to a down-hole tube, for example. The system 300 comprises a heater 310 configured to heat a working fluid to a high temperature. The heater 310 is positioned on the surface and is configured to operate on any of a variety of energy sources.

Figure 3A:
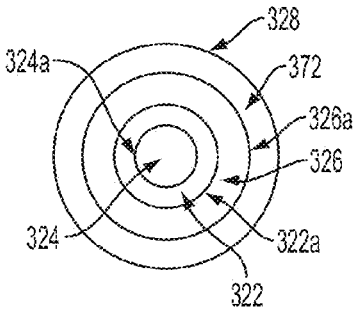
FIG. 3A depicts a casing system of the heat delivery and distribution system of FIG. 3 configured in a set of concentric tubes.

The heated working fluid is delivered down to a location in the down-hole tube through a casing system 320, the length of the casing system 320 corresponding to the depth of the well, for example. In accordance with the embodiment of FIG. 3, the casing system 320 is configured in the form of a set of concentric tubes 324*a*, 322*a* and 326*a* (as depicted by FIG. 3A). The concentric tubes form a center string 324, a first annulus 322, a second annulus 326 and an outer annuls 372.

In the embodiment of FIG. 3, the first annulus 322 of the casing system 320 is used to transport the heated working fluid to a point near the bottom of a well. The heated working fluid is delivered to a point 330 and reverses direction. The cooled working fluid is returned to the surface through the center string 324.

The recovered hydrocarbons are transported from the well bottom to the surface through the second annulus 326. The recovered hydrocarbons gain heat from the downward moving working fluid in the first annulus 322. The recovered hydrocarbons may be stored in a storage unit 340.

The closed-loop system for the working fluid includes a working fluid pump 350 that is preferably positioned on the cold side of the heater 310. Additionally, a reserve storage flask 360 containing additional working fluid is included in the closed loop to ensure sufficient working fluid in the system.

An outer casing 328 forms the outer wall of the casing system 320 and a casing annulus 372 described in detail below. The outer casing 328 is provided with perforations 380 to allow hydrocarbons to enter the casing and then flow up through the casing system 320.

The casing annulus 372 is used to inject a lift gas into the recovered hydrocarbons to facilitate extraction of the hydrocarbons. In the embodiment of FIG. 3, the lift gas is injected into an injection point 370 near the surface (e.g., near the well head in FIG. 3) and into the casing annulus 372. The casing annulus 372 conducts the lift gas at high pressure to one or more gas-lift injection ports 374 located near the bottom of the well and/or at other elevations as necessary in accordance with the design of the well. A packer system 376 is provided within the casing annulus below the lower most injection ports 374 to isolate the lift gas from fluids entering the casing at lower pressure.

The injection gas enters the stream of recovered hydrocarbons in the second annulus 326 at the injection ports 374. The injection gas reduces the density of the hydrocarbons and produced water and facilitates flow of the hydrocarbons and water to the surface.

While FIGS. 1-3 describe various features, one skilled in the art will understand that various combinations and permutations of the features are possible and are contemplated within the scope of the present invention. For example, while FIG. 3 illustrates the use of lift gas in a land-based well, the lift gas system may also be implemented with an off-shore system illustrated in FIGS. 1 and 2.

Thus, various embodiments of the present invention may be used for prevention or remediation of cold water temperature, natural or induced processes in sub-sea floor, down-hole, sea floor, sea floor-to-ocean surface, and surface tubulars.

In various embodiments, the working fluid system may have differing configurations. In one embodiment, the working fluid system is a multi-purpose, integrated system configured to provide heating to various sub-systems. For example, the working fluid system may have a three-branch configuration to provide heating to (1) surface equipment; (2) riser systems and (3) the co-axial concentric tubing, as described further below. In other embodiments, a single branch configuration may be provided with manual valve controls or automated valves with manual over-ride.

In a particular embodiment, the system includes a variety of sub-systems for operation. These systems may include:

(1) heat demand, generation & deliver controller (DGDC);

(2) surface located heat generation unit (SHGU);

(3) primary heat distribution system (PHDS);

(4) surface facilities heat delivery & distribution system (SHDS);

(5) surface facilities heat exchanger unit (SHEU);

(6) riser heat delivery & distribution system (RHDS);

(7) riser systems heat exchanger unit (RHEU);

(8) co-axial heat delivery & distribution system (CHDS);

(9) sea floor systems heat exchanger unit (FHEU);

(10) sub-sea floor & down-hole heat exchanger unit (DHEU);

(11) cold working fluid return system (WFRS);

(12) cold working fluid storage system (WFSS).

Each of these systems according to one embodiment are described below in detail.

Heat Demand, Generation & Delivery Controller (DGDC)

The DGDC includes an integrated analog and digital process control system which includes a computer based human interface, software and firmware logic system, and in situ analog and/or digital sensors. The software and firmware logic system is configured to monitor heat demand, heat delivery and cold return through sensors located at appropriate positions. The software and firmware logic system is further configured to calculate heat demand and delivery parameters and to regulate heating rate and delivery rate of the working fluid. The analog sensors allow monitoring of the working fluid by thermo-couple heat sensors at hot and cold sides of the heat exchanger unit. The analog sensors also include flow rate sensors, such as Q bar or torque bar sensors, for example, on the cold side of the heat exchanger unit in split processes or multiple distribution point configurations.

The DGDC further includes a remote sensor signal transmission and surface receiver system which includes (1) in situ broad temperature range microprocessor; (2) in situ data transmission system; and (3) remote components which are battery powered with an integrated charging system.

The in situ broad temperature range microprocessor converts in situ analog sensor values to binary data and controls the in situ data transmission system.

The in situ data transmission system transmits data up signal cable in direct wire connected applications, controls fluid pulse via a cold side telemetry system for down-hole applications, and controls external acoustic signal (similar to SONAR) generator for wireless open marine applications by activation of a piezo-electric crystal.

The remote components which are battery powered with an integrated charging system include a hot/cold loop turbine or a cold side working fluid powered turbine.

The DGDC also includes a remote process signal delivery system which, in direct wire applications, conducts signal via an external signal wire. Further, a surface-located cold-side working fluid back pressure actuator sends a signal to an in situ process control unit.

Surface Located Heat Generation Unit (SHGU)

The SHGU is provided to heat the working fluid, which has a high-temperature boiling point and a low vapor pressure. The SHGU further delivers heat to the PHDS and receives cold working fluid from the WFSS. The SHGU may generate heat by combustion of gas, liquid or solid carbon-energy fuel. Alternatively, the SHGU may generate heat using electrical heating elements or a combination of electrical and combustion processes.

Primary Heat Distribution System (PHDS)

The PHDS includes main distribution manifolds to route working fluid from working fluid storage system (WFSS) through pumps and SHGU to targeted functional systems. An insulated manifold conducts cold working fluid to SHGU from WFSS through parallel pressure pump system. In this regard, Y-junctions to two or more pressure pumps in parallel allow full redundancy. An optional pump configuration includes a hydraulic pump drive with pump output rate controlled by a hydraulic system. The pump output is routed via a second Y-junction to a single manifold that feeds cold working fluid to SHGU. Check valves with back up gate valves are provided to isolate parallel pumps. The pump rate is controlled by DGDC to regulate flow rate through SHGU.

The hot working fluid is routed by serial Y-junctions to three flow branches. All branches are isolated by gate valves. The main manifold includes three separate branch and flow rate metering systems. The branches correspond to: (1) a surface equipment heating loop; (2) a riser systems heating loop; and (3) a co-axial concentric tubing loop. Gate valves are electrical or hydraulic remote control with full manual over ride by mechanical link separated by safe distance and heat shielded control point. Metering valves are located down stream from gate valves and have same remote & over ride arrangement. All computer controlled valve systems have full manual over ride from heat shielded mechanical control stations.

Surface Facilities Heat Delivery & Distribution System (SHDS)

The SHDS delivers hot working fluid to provide heat for any surface process. All lines are insulated and shielded from impact. Heavier wall thickness provides safety against expansion and deformation. All valve systems have remote mechanical link to shielded control point.

Surface Facilities Heat Exchanger Unit (SHEU)

The SHEU includes linear co-axial tubing to heat secondary fluids to specified temperatures. The working fluid can be in axial or annular path, depending upon heat and pressure characteristics of the secondary fluid. The through-put of the working and secondary fluids plus temperature of working fluid can be individually varied to obtain desired temperature and volume of secondary fluid. A heat coil may be provided in the vessel for mass heating or process pre-heating. For higher temperature targets for the secondary fluid, remaining heat in the working fluid exiting from the co-axial precision heating process can pre-heat a large volume storage reservoir.

Riser Heat Delivery & Distribution System (RHDS)

In the RHDS, the hot working fluid can be routed to heat exchangers located in or around first annulus of the riser system. Insulated flow tubes located external to riser can deliver hot working fluid to custom riser joints that house RHEUs.

Riser Systems Heat Exchanger Unit (RHEU)

The RHEU includes spiral tubes affixed to an inner surface of the riser. The spiral tubes heat fluids in outermost annulus of the riser system. Shielding and stand-off protection may be provided from the inner strings or annulus. Exchange tubes are affixed to an inner jacket separated from the inner surface of the riser by insulation.

Co-Axial Heat Delivery & Distribution System (CHDS)

The CHDS includes concentric tubes to convey hot and cold working fluid. The hot working fluid is pumped down a central tube for delivery to the FHEU & DHEU systems. The central tube can be insulated to minimize heat loss. The cooled working fluid returns up the first adjacent annuls. High working-fluid displacement rates are achieved through small-diameter tubes to minimize residence time of the working fluid in environments which can cause high heat loss. The working fluid volume in the FHEU and DHEU systems should be significantly greater than volume of delivery system to allow maximum heat transfer to the target. The produced fluids and gas (e.g., hydrocarbons) are conducted to the surface via a second annulus.

Sea Floor Systems Heat Exchanger Unit (FHEU)

The FHEU may have a large working-space configuration or a small working-space configuration. In the large working-space configuration, reduction in gas hydrates in a blowout containment vessel may be achieved. A brute force configuration includes short lengths of very heavy wall tubing in a ladder configuration with heat sink fins designed for high temperature transients. A long-term service configuration includes boiler style heat loops with ample allowance for deformation with rapid temperature transients.

The small working space configuration is an in-line configuration with concentric three-string co-axial configuration of tubes with routing of hot working fluid, cold working fluid and a secondary fluid determined by the heat target, secondary fluid properties and heat loss considerations.

Sub-Sea Floor & Down-Hole Heat Exchanger Unit (DHEU)

The DHEU may be adapted for injector applications or for producing well applications. For injector applications, the system may include steam generation and injection or hot brine water flood injection. For steam generation and injection, hot working fluid is provided in the center string, and high pressure water is pumped down the first adjacent annulus and flashed to steam at the shoe of the tubing string in the well. The cold working fluid is returned in an outer annulus. For hot brine water flood injection, the rate is regulated to prevent partial flash to low-quality steam.

In producing well applications, viscosity reduction of high-pour point crudes and continuous or intermittent dewaxing may be achieved. In this regard, cold working fluid returns in the center string, and hot working fluid is transmitted in the first adjacent annulus. The produced hydrocarbons are transmitted up the outer annulus. The casing to the outer tubing annulus can convey gas for gas lift. A cooling effect of the gas lift process is offset by heat from the hot working fluid.

Cold Working Fluid Return System (WFRS)

The WFRS may be configured for surface and riser applications or sea floor and sub-sea floor applications. For surface and riser applications, cold working fluid is returned to WFSS via a parallel piping system. The pipes are insulated and shielded in the same manner as hot working fluid tubulars for safety and preservation of residual heat.

For sea floor and sub-sea floor applications, a three-string concentric co-axial tubing arrangement is implemented. The cold working fluid can flow up at higher, same or slower rates than the hot working fluid flows down by pre-selection or design of the annular radii. The cold working fluid return rate is determined by a heat balance between the needs of the heat exchanger and the need to transfer additional heat to concentric production string.

A booster pump may be required to regulate flow of returned cold working fluid to the working fluid storage flask.

Cold Working Fluid Storage System (WFSS)

The WFSS includes a storage vessel that is insulated to minimize loss of residual heat and backflow of heat due to entropy. The storage vessel is pressure rated according to the properties of the working fluid. Compensation for "always full" and differential expansion of the working fluid and hardware is provided. The storage vessel is "recharged" from a cold reserve tank with variable rate and slip centrifugal pump to maintain constant pressure and fluid level in the storage vessel.

In preferred embodiments, for all surface manifolds, castings and extrusions are designed for 1,200° F. and 5,000 psi operation, and are insulated and not subject to extreme temperature transients.

All below-sea level hot working fluid distribution tubes, vessels and heat exchangers may not be insulated, may be subjected to extreme temperature transients and high contrast temperature gradients across tubing walls and subject to extreme long-axis expansion and deformation in response to rapid temperature changes.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. A method of recovering hydrocarbons located at or above a sea floor of a sea, comprising:

heating a working fluid contained in a closed-loop system at a heater, wherein the working fluid contained in the closed-loop system is only molten salt;

delivering the working fluid downward through a first string of a riser that forms a part of the closed loop system to a heat exchanger located in the sea at or above the sea floor, the riser having a plurality of strings in a concentric arrangement;

wherein the heat exchanger transfers only thermal energy from the working fluid to at least hydrocarbons to enable recovery of hydrocarbons;

receiving recovered hydrocarbons through a second string of the riser; and returning the working fluid from the heat exchanger to the heater through a third string of the riser that forms another part of the closed loop system.

2. The method of claim 1, further comprising heating, via the heater, the working fluid to a temperature that is greater than 700° F. and to as high as 1150° F.

3. The method of claim 1, further comprising positioning the heater on a surface of a vessel or rig that is on the sea, and providing the heat exchanger in a recovery bell that is configured to trap hydrocarbons venting at or above the sea floor below the surface of the vessel or the rig and to provide the trapped hydrocarbons as the recovered hydrocarbons to the second string.

4. The method of claim 1, further comprising positioning the heater on a surface of a vessel or rig that is on the sea, providing the heat exchanger in a recovery bell that is configured to trap hydrocarbons venting at or above the sea floor below the surface of the vessel or the rig, and transferring heat from the working fluid to the recovery bell via the heat exchanger.

5. The method of claim 1, further comprising positioning the heater on a surface of a vessel or rig that is on the sea, providing the heat exchanger in a recovery bell that is configured to trap hydrocarbons venting at or above the sea floor below the surface of the vessel or the rig, and sending the recovery bell to the sea floor below the surface of the vessel or the rig to trap and recover the venting hydrocarbons.

6. The method of claim 1, further comprising positioning the heater on a surface of a vessel or rig that is one the sea, and providing the heat exchanger in a recovery bell that is configured to trap hydrocarbons venting at or above the sea floor below the surface of the vessel or the rig and to provide the trapped hydrocarbons as the recovered hydrocarbons to the second string, sending the recovery bell to the sea floor below the surface of the vessel or the rig to trap and recover the venting hydrocarbons, transferring heat from the working fluid to the recovery bell via the heat exchanger, wherein the trapped hydrocarbons are provided as the recovered hydrocarbons to the second string by the heated recovered bell.

7. The method of claim 1, wherein the riser has an outer casing which surrounds the strings, said casing being provided with a packer system and one or more injection ports which permit an injected lift gas to enter into the second string, wherein the packer system is provided below the one or more injection ports, and wherein said method further comprises injecting the lift gas into the outer casing such that the lift gas is injected via the one or more injection ports into the recovered hydrocarbons received in the second string.

8. The method of claim 1, wherein the riser has an outer casing which surrounds the strings, said casing being provided with perforations adjacent an end thereof, a packer system and one or more injection ports which permit an injected lift gas to enter into the second string, wherein the packer system is provided below the one or more injection ports and above the perforations, and wherein the method further comprises injecting the lift gas into the outer casing such that the lift gas is injected via the one or more injection ports into the recovered hydrocarbons received in the second string, and wherein the recovered hydrocarbons are recovered from the sea via the perforations.

9. An apparatus for recovering hydrocarbons located at or above a sea floor of a sea from a vessel or rig on the sea, comprising:

a heater located on a surface of the vessel or rig and configured to heat a working fluid contained in a closed-loop system, wherein the working fluid contained in the closed-loop system is only molten salt;

a riser having a plurality of strings in a concentric arrangement and an end positionable in the sea at or above the sea floor;

a heat exchanger located adjacent the end of the riser and configured to transfer only thermal energy from the working fluid to at least hydrocarbons to enable recovery of hydrocarbons;

wherein the plurality of strings of the riser includes:

a first string forming a part of the closed loop system and configured to deliver the working fluid downward into the sea and to the heat exchanger;

a second string configured to receive recovered hydrocarbons at or above the sea floor; and a third string forming another part of the closed loop system and configured to return the working fluid from the heat exchanger to the heater at the surface of the vessel or rig.

10. The apparatus of claim 9, wherein heat exchanger is provided in a recovery bell that is configured to trap hydrocarbons at or adjacent the sea floor, and wherein heat exchanger is configured to transfer heat from the working fluid to the recovery bell.

11. The apparatus of claim 9, wherein the heater heats the working fluid to a temperature that is greater than 700° F. and to as high as 1150° F.

12. The apparatus of claim 9, wherein the first string is a center string of the plurality of strings in the concentric arrangement with a tube diameter of approximately 0.75 inches or more.

13. The apparatus of claim 9, wherein the second string has an outer wall formed of a 5.5-inch casing.

14. The apparatus of claim 9, wherein the third string is a tube having an outer diameter of between 2.5 to 3 inches and which is located between the first and second strings.

15. The apparatus of claim 9, wherein insulation is provided between the first and third strings.

16. The apparatus of claim 9, wherein the riser is an insulated riser configured to minimize heat loss to sea water and which has a diameter between 12 to 16 inches.

17. The apparatus of claim 9, wherein the closed-loop system has a working fluid pump positioned on a cold side of the heater along with a reserve storage flack containing additional working fluid, and wherein the second string is connected to a storage unit which receives the recovered hydrocarbons.

18. The apparatus of claim 9, wherein the heat exchanger is selected from a heat exchange that is provided as a jacket which surrounds a well head located at the sea floor, a heat exchanger with heat loops, and a heat exchange with a ladder configuration of tubing provided with heat sink fins.

19. The apparatus of claim 9, wherein the riser has an outer casing which surrounds the strings, said casing being provided with a packer system and one or more injection ports which permit an injected lift gas to enter into the second string, wherein the packer system is provided below the one or more injection ports, and wherein the apparatus further comprise an injection point for injecting the lift gas into the outer casing such that the lift gas is injected via the one or more injection ports into the recovered hydrocarbons received in the second string.

20. The apparatus of claim 9, wherein the riser has an outer casing which surrounds the strings, said casing being provided with perforations adjacent an end thereof, a packer system and one or more injection ports which permit an injected lift gas to enter into the second string, wherein the packer system is provided below the one or more injection ports and above the perforations, and wherein the apparatus further comprise an injection point for injecting the lift gas into the outer casing such that the lift gas is injected via the one or more injection ports into the recovered hydrocarbons received in the second string, and wherein the recovered hydrocarbons are recovered from the sea via the perforations.

* * * * *

UNITED STATES PATENT AND TRADEMARK OFFICE

CERTIFICATE OF CORRECTION

PATENT NO. : 8,955,591 B1
APPLICATION NO. : 13/107711
DATED : February 17, 2015
INVENTOR(S) : Kent B. Hytken It is certified that error appears in the above-identified patent and that said Letters Patent is hereby corrected as shown below:

In the claims,

Col. 9, Claim 6, Line 48,
"the heater on a surface of a vessel or rig that is one the sea, and" should read
--the heater on a surface of a vessel or rig that is on the sea, and--; and Col. 11, Claim 18, Line 1,
"exchanger with heat loops, and a heat exchange with a ladder" should read
--exchanger with heat loops, and a heat exchanger with a ladder--.

Signed and Sealed this
Twenty-second Day of March, 2016

Michelle K. Lee

Michelle K. Lee
*Director of the United States Patent and Trademark Office*